United States Patent [19]

Rodgers

[11] 4,421,276

[45] Dec. 20, 1983

[54] CONVERTIBLE SPRINKLER

[76] Inventor: J. Linn Rodgers, 9606 La Serna Dr., Whittier, Calif. 90605

[21] Appl. No.: 323,320

[22] Filed: Nov. 20, 1981

[51] Int. Cl.[3] ..... B05B 15/06

[52] U.S. Cl. ..... 239/273; 239/289; 239/525

[58] Field of Search ..... 239/273, 280, 289, 525, 239/526; 405/387

[56] References Cited

U.S. PATENT DOCUMENTS 2,814,526 11/1957 Blair ..... 239/280

*Primary Examiner*—John J. Love
*Assistant Examiner*—Jon M. Rastello
*Attorney, Agent, or Firm*—Donald D. Mon

[57] ABSTRACT

A convertible sprinkler which can be used as a ground sprinkler or as a hand sprinkler. The sprinkler has a pair of feet in the form of paddles hingedly connected to the sprinkler head in a dihedral relationship. When folded together, these feet form a handle. When they are unfolded, they provide a stable base for using the sprinkler as a ground sprinkler.

5 Claims, 5 Drawing Figures

FIG. 1
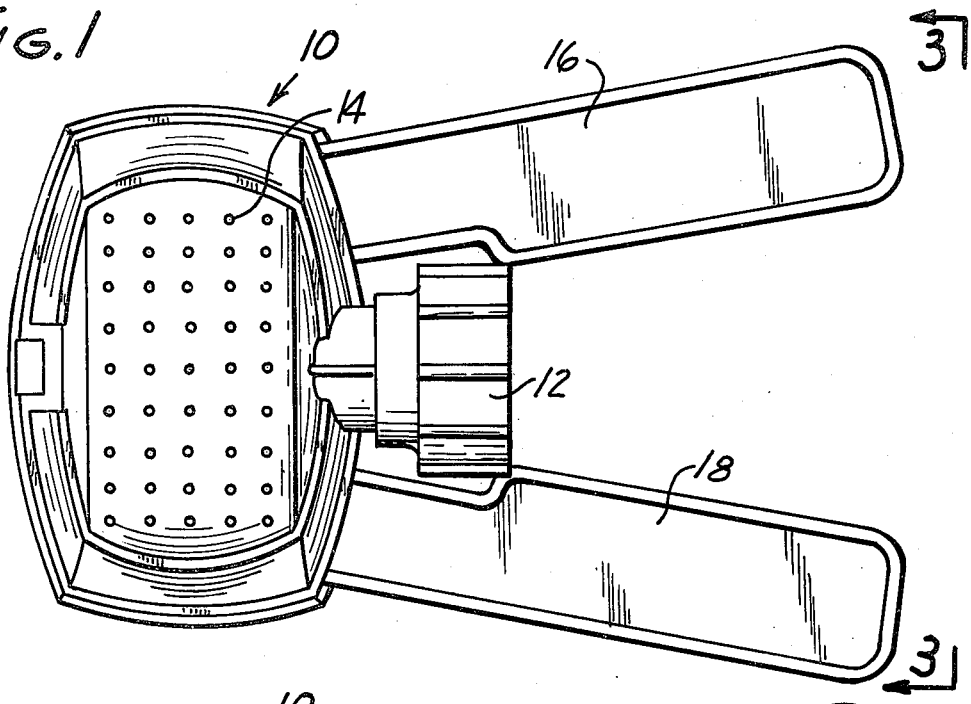
FIG. 2
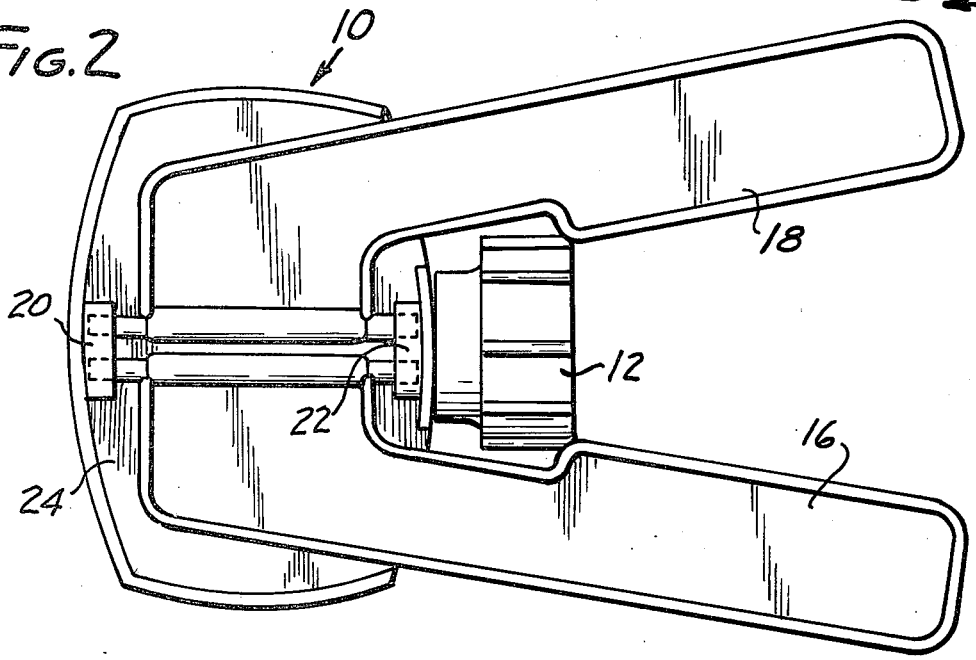
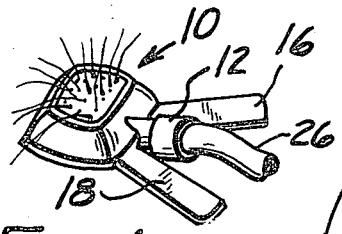
FIG. 4
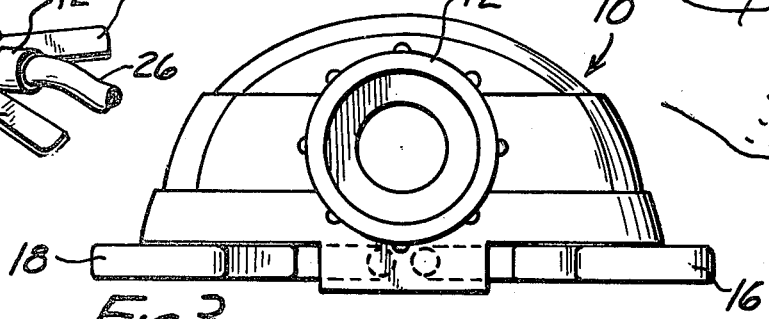
FIG. 3
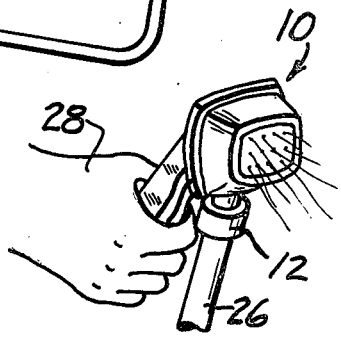
FIG. 5

CONVERTIBLE SPRINKLER

FIELD OF THE INVENTION

This invention relates to garden sprinklers and more particularly it relates to a convertible sprinkler head which can be used as a ground sprinkler or as a hand sprinkler (sometimes called a "nozzle").

BACKGROUND OF THE INVENTION

The general construction of sprinklers is to provide for lawn or area watering by using a sprinkler head as a free-standing sprinkler on the ground or a flat surface, usually with a framework rigidly attached to the sprinkler head and adapted to be placed on the ground. Thus, the area being watered is limited to the sprinkling pattern of the sprinkler head. In order to hand water areas that are not easily reached by the sprinkler when used as such, some other device is attached to the hose instead, perhaps a spray nozzle. Presently there is no convenient way simply to pick up the sprinkler and use it as a hand-held device.

BRIEF DESCRIPTION OF THE INVENTION

The purpose of the present invention is to allow a sprinkler to be used as a ground sprinkler or as a hand sprinkler. The present invention involves the provision of a sprinkler head having two feet which form a stable base which may be folded in a dihedral movement to form instead a convenient handle so that the sprinkler head can comfortably be held and used as a hand-held sprinkler. The feet are generally in the form of paddles hingedly attached to the bottom of the sprinkler which may be readily folded to form a handle. In the unfolded position they form a stable base for the sprinkler head. The paddles are connected to the bottom or base of the sprinkler head along the edge of what can be a dihedral angle so that when in the unfolded position they extend outwardly and preferably flat at the bottom of the sprinkler head. In the folded position they form an angled handle which provides easy clearance for the hose attached to the hose connection of the sprinkler head while the device is held in the hand.

It is an object of the present invention to provide a convertible sprinkler which may be easily used as a ground sprinkler.

Yet another object of the present invention is to provide a convertible sprinkler which may be easily converted to a hand-held sprinkler.

Still another object of the present invention is to provide a convertible sprinkler which is easily converted from a ground sprinkler to a hand-held sprinkler by means of a base which can serve as a handle.

Still another object of the present invention is to provide a convertible sprinkler having hinged feet which form a solid base in one position and when folded form a useful handle for utilizing the sprinkler as a hand-held sprinkler.

The above and other features of the invention will be fully understood from the following detailed description and the accompanying drawings, in which:

BRIEF DESCRIPTION OF THE DRAWINGS

FIG. 1 is a top view of the convertible sprinkler according to the invention;

FIG. 2 is a bottom view of the sprinkler according to the invention;

FIG. 3 is an end view of the invention taken at line 3—3 in FIG. 1;

FIG. 4 illustrates the sprinkler in use as a ground sprinkler; and

FIG. 5 illustrates the sprinkler in use as a hand-held sprinkler.

DETAILED DESCRIPTION OF THE INVENTION

The invention is generally shown in FIGS. 1–3. It is comprised of a sprinkler head 10 having the usual hose connection 12 for delivering water to sprinkler outlets 14. The sprinkler shown in the Figs. produces a rectangular pattern, but obviously other patterns may easily be provided for by altering the hole pattern.

Structure to adapt sprinkler head 10 for its multiple uses comprises feet in the form of paddles 16 and 18, hingedly mounted in sockets 20 and 22. The hinged connection of the paddles 16 and 18 are along an edge forming a dihedral angle. While the hinged edges need not lie in the same line, it is preferred that they close together in order to make a better handle for the hand. Thus, the term "dihedral edge" includes hinged edges which are parallel but spaced apart by a distance not so great as to frustrate the use as a handle. Sprinkler head 10 is also provided with a recess 24 in which paddles 16 and 18 fit into when rotated to their flat position to form a base for sprinkler head 10.

The feet or paddles 16 and 18 angle outwardly away from sprinkler head 10 and extend toward hose connection 12. In this position they provide a stable base for utilizing the sprinkler as a ground sprinkler as illustrated in FIG. 4. The feet 16 or 18 are rotated into their flat position with the hose 26 connected to the sprinkler connection 12 as shown. The sprinkler may now be readily used as a ground sprinkler.

To convert the sprinkler into a hand sprinkler, the feet or paddles 16 and 18 are folded together as illustrated in FIG. 5. The angular outward extension of the feet 16 and 18 serves to provide clearance for hand 28 when the feet are folded together to form a handle as shown in FIG. 5. By simply rotating feet 16 and 18 in sockets 20 and 22 the handles fold together to form a handle which is easily gripped by the hand. The sprinkler may thereby be used as hand-held sprinkler as shown.

Thus there has been disclosed a convertible sprinkler which utilizes feet or paddles which in one position form a base for a sprinkler head, but when rotated back-to-back form a convenient handle for utilizing the sprinkler as a hand-held sprinkler. The feet are so constructed that they extend in an angular fashion away from the sprinkler head toward the hose connection to provide a stable base when used as a ground sprinkler and to provide easy clearance for the hand when used as a hand-held sprinkler.

This invention is not to be limited by the embodiment shown in the drawings and described in the description, which is given by way of example and not of limitation, but only in accordance with the scope of the appended claims.

I claim:

1. A convertible sprinkler head comprising: a sprinkler head; a pair of paddles having adjacent ends, each said adjacent end connected to said sprinkler head by a longitudinally extending hinge, the longitudinal axis of said hinges being generally parallel to each other such that said paddles can be folded together to form a handle or may be unfolded flat to form a stable base for said sprinkler head.

2. The device according to claim 1 in which said sprinkler head has a recessed bottom, and in which said paddles when unfolded fit into said recess.

3. The device according to claim 2 in which said paddles when unfolded angularly extend away from each other thereby providing a stable base.

4. The device according to claim 1 in which said sprinkler head has a hose connection having an axis; said paddles when unfolded angularly extend toward said hose connection on either side of said axis.

5. The device according to claim 4 in which said paddles when folded together lie in the same plane as said axis.

* * * * *